US007263815B2

(12) United States Patent
Ballestrazzi et al.

(10) Patent No.: US 7,263,815 B2
(45) Date of Patent: Sep. 4, 2007

(54) PROCESS FOR FEEDING PRODUCTS OF VARIABLE HEIGHT AND LENGTH INTO A CONTINUOUS PACKAGING APPARATUS

(75) Inventors: Aris Ballestrazzi, Modena (IT); Lamberto Tassi, Modena (IT)

(73) Assignee: Sitma S.p.A., Spilamerto, Modena (IT)

( * ) Notice: Subject to any disclaimer, the term of this patent is extended or adjusted under 35 U.S.C. 154(b) by 3 days.

(21) Appl. No.: 11/115,045

(22) Filed: Apr. 25, 2005

(65) Prior Publication Data

US 2005/0235605 A1 Oct. 27, 2005

(30) Foreign Application Priority Data

Apr. 27, 2004 (IT) ..... MI2004A0831

(51) Int. Cl.
*B65B 9/06* (2006.01)

(52) U.S. Cl. ..... 53/450; 53/55; 53/504

(58) Field of Classification Search ..... 53/504, 53/55

See application file for complete search history.

(56) References Cited

U.S. PATENT DOCUMENTS

| | | | | |
|---|---|---|---|---|
| 4,141,196 | A * | 2/1979 | Blanding | 53/550 |
| 4,381,637 | A * | 5/1983 | Ballestrazzi et al. | 53/51 |
| 4,546,595 | A | 10/1985 | Yasumune et al. | |
| 4,726,168 | A * | 2/1988 | Seko | 53/450 |
| 5,299,410 | A * | 4/1994 | Freeman | 53/442 |
| 5,347,791 | A * | 9/1994 | Ginzl et al. | 53/450 |
| 5,351,464 | A | 10/1994 | Francioni et al. | |
| 5,566,526 | A * | 10/1996 | Suga | 53/75 |
| 5,653,094 | A * | 8/1997 | Kivits et al. | 53/461 |
| 5,675,958 | A * | 10/1997 | Shanklin et al. | 53/374.6 |
| 6,374,580 | B1 * | 4/2002 | Kujubu et al. | 53/450 |

FOREIGN PATENT DOCUMENTS

| | | |
|---|---|---|
| EP | 0 304 978 A | 3/1989 |
| EP | 0 375 857 A | 7/1990 |
| EP | 0 699 583 A | 3/1996 |
| EP | 0 712 782 A | 5/1996 |
| EP | 0 870 678 A | 10/1998 |

OTHER PUBLICATIONS

EPO Search Report.

* cited by examiner

*Primary Examiner*—John Sipos
(74) *Attorney, Agent, or Firm*—Hedman & Costigan PC; James V. Costigan

(57) ABSTRACT

A Process for feeding products of variable height and length into a continuous packaging apparatus comprising a conveyor with thrusters that receives publishing products or similar, such as newspapers, magazines, books, envelopes, giveaways or other similar products, from a certain number of feeders, a conveyor belt where the packaging in a plastic or paper film takes place, fed continuously above the conveyor belt that foresees, in a downstream area, longitudinal and transversal sealing devices that make finished packages of various sizes in height and length, said process comprising the steps of: varying the pitch on the conveyor belt of the products or groups of products fed by the conveyor with thrusters through continuous variation of the speed of the conveyor belt, and operatively adapting the speed of the sealing devices to the sizes in height and length of the products or groups of products.

5 Claims, 1 Drawing Sheet

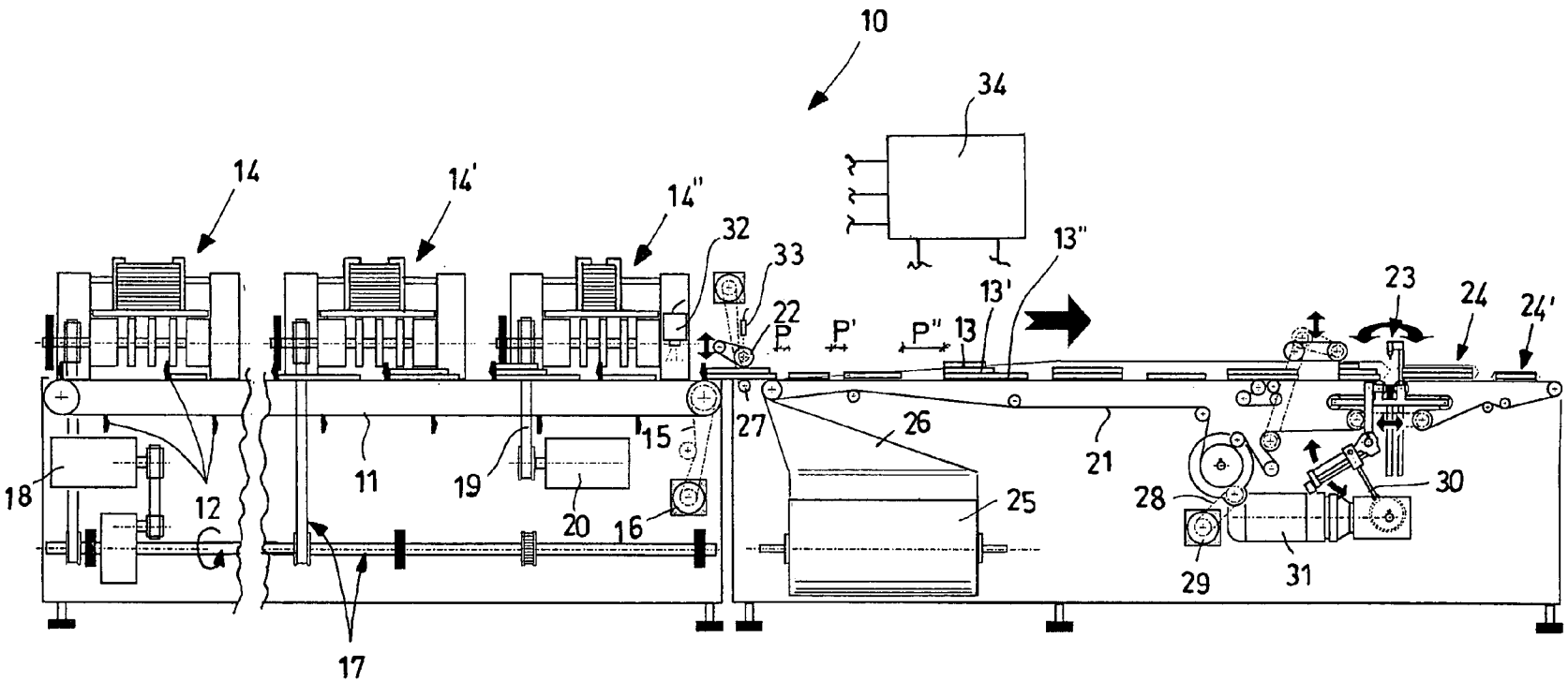
10
11
12
13
13'
13"
14
14'
14"
15
16
17
18
19
20
21
22
23
24
24'
25
26
27
28
29
30
31
32
33
34
P
P'
P"

PROCESS FOR FEEDING PRODUCTS OF VARIABLE HEIGHT AND LENGTH INTO A CONTINUOUS PACKAGING APPARATUS

The present invention refers to a process for feeding products of variable height and length into a continuous packaging apparatus.

In the field of the selection and transportation of so-called publishing products, such a sheeted products or similar, newspapers, magazines, books, envelopes, giveaways or other supplements, in particular coming from feeders associated in parallel with packaging apparatuses, up to now a solution has not been found for the continuous packaging of products having a continuously variable length and height, variously combined together.

Indeed, in general, the packaging machine and its feeding parts are currently adjusted according to the products that must be fed that must be of the same or similar size, with constant measurements, to be able to have a correct operation of the various parts of the machine.

As these sizes change, the machine is stopped and reset with the new parameters before being able to restart its packaging work of products having substantially predetermined sizes.

The purpose of the present invention is therefore that of solving such problems, trying to carry out continuous packaging of publishing products that are continuously variously associated and of variable size in height and in length, without needing any stopping of the machine.

This purpose according to the present invention is accomplished by carrying out a process for feeding products of variable height and length into a continuous packaging apparatus, according to what is outlined in the independent claims.

Other characteristics emerge from the subsequent attached claims.

The characteristics and advantages of a process for feeding products of variable height and length into a continuous packaging apparatus according to the present invention shall become clearer from the following description, given as an example and not for limiting purposes, referring to the attached schematic drawing, in which a top side view of a continuous packaging apparatus is illustrated that carries out the process for feeding products of variable height and length.

With reference to the drawing, a continuous packaging apparatus is schematically shown, indicated with 10, comprising a conveyor 11 with thrusters 12 that receives publishing products or similar 13, 13', 13", etc., such as newspapers, magazines, books, envelopes, giveaways or other similar products, from a certain number of feeders schematised at 14, 14', 14", etc.

The conveyor 11 is motorised through a transmission 15 and a motor 16, whereas the feeders are motorised, for example those indicated with 14, 14' through a centralised transmission 17 and a single motor 18, and the one indicated with 14" with relative transmission 19 through a motor 20.

Such products 13, 13', 13", variously associated thanks to the selective feeding from the various feeders 14, 14', 14", are fed according to a suitably selected pitch p, p', p", etc. to a conveyor belt 21 where the definitive packaging takes place. Indeed, at an area downstream of such a conveyor belt 21 longitudinal and transversal sealing devices 23 are foreseen that make finished packages 24, 24', etc. of various sizes in height and length with the process according to the invention.

Below the conveyor belt 21 a roll 25 of plastic or paper film 26 is foreseen that is continuously fed above the conveyor belt 21 ready to receive above it the groups of products that are received from the conveyor 11 with thrusters 12.

A small upper entry belt 22 that can be displaced in height and a lower motorised roller 27 make a highly adjustable feeding group that eases and collaborates with such feeding between the conveyor 11 with thrusters 12 and the conveyor belt 21.

A suitable transmission 28 commanded by a motor 29 actuates the advancing of the entire conveyor belt 21, whereas a further composite transmission 30 actuated by a respective motor 31 selectively activates the longitudinal and transversal sealing devices 23.

A sensor 32 for detecting the height of the group of piled up products associated with at least one sensor 33 for detecting length are foreseen, said sensors determining the pitch between the successive groups of products alternatively and/or in collaboration with a central computer, schematised at 34.

Of course, the central computer 34 also manages all of the motors quoted previously and possible other auxiliary devices so as to allow the packaging process to be synchronised and actuated.

Therefore, according to the invention, following the programmed feeding in successive piled up combination of preselected products 13, 13', 13", etc. the conveyor 11 with thrusters 12 receives groups of products. Of course, these products are fed according to a predetermined sequence one upon the other by the various feeders 14, 14', 14", etc. combined with the conveyor 11 with thrusters 12.

The advancing of such products or groups of products 13, 13', 13", etc. is signalled by the computer 34 to the various motors so that it is possible to actuate the process of the invention. In particular, according to the maximum length and height of each group of products, a variation of the pitch p, p', p", etc. between the various groups of products takes place.

Such a variation is carried out by continuously varying the speed of the conveyor belt 21 according to the maximum length and height of each group of products that arrives from the conveyor 11 with thrusters 12 and operatively adapting the speed of the sealing devices 23 to the sizes in height and length of the products or groups of products 13, 13', 13", etc. that have arrived on the conveyor belt 21.

Therefore, the computer 34 foresees continuous control and command of the speed of the motor 29 that actuates the transmission of the entire belt of the conveyor 21. Moreover, it foresees continuous control and command of the speed of the motor 31 that actuates the composite transmission 30 that in turn selectively activates the longitudinal and transversal sealing devices 23.

Alternatively or else in parallel, the sensor 32 that is able to detect the maximum length and height of each group of products coming out from the conveyor 11 with thrusters 12 can take care of activating the computer 34 or else of confirming the command thereof quoted previously.

It is also possible to foresee a further sensor 33 for detecting length that collaborates with the possible control of the real length of each group of products, activating the confirmation of the variation of the pitch between the successive groups of products in collaboration with the central computer 34.

The present invention thus provides a solution to the problems of the prior art by carrying out continuous packaging of publishing products that are continuously variously associated and of variable size in height and in length, without needing any stopping of the packaging apparatus.

The invention claimed is:

1. A Process for feeding products of variable height and length into a continuous packaging apparatus comprising a variable speed conveyor (11) with a plurality of thrusters (12) that receives publishing products (13, 13', 13"), from a plurality of feeders (14, 14', 14"), a second adjustable pitch conveyor belt (21) where plastic or paper film (26) is fed continuously above said second conveyor belt (21) and towards a plurality of longitudinal and transversal sealing devices (23) that make finished packages (24, 24') of various sizes in height and length; said apparatus further characterized by a centralized computer (34) that directs the packaging process, said process comprising the steps of: varying the pitch on said second conveyor belt (21) of said products or groups of products (13, 13', 13") fed by the conveyor (11) with thrusters (12) through continuous variation of the speed of said second conveyor belt (21), and operatively adapting the speed of said sealing devices (23) to the sizes in height and length of said products or groups of products (13, 13', 13"), said apparatus is further characterized in that in a step of passing over said products or groups of products (13, 13', 13") between said conveyor (11) with thrusters (12) and said conveyor belt (21) the position in height of a height-adjustable feeding group (22, 27) is varied according to the height of said products or groups of products (13, 13', 13").

2. The process according to claim 1, further characterized in that a height detector mechanism (32), which detects the height of said products or groups of products (13, 13', 13") is located at the exit of said conveyor (11) with thrusters (12).

3. The process according to claim 1, characterized in a length detector mechanism (33), which detects the length of said products or groups of products (13, 13', 13", etc.) at the exit of said conveyor (11) with thrusters (12).

4. Process according to claim 1, characterized in that said feeders (14, 14', 14") are activated through a centralized transmission (17) and a single motor (18).

5. Process according to claim 1, characterized in that said feeders (14, 14', 14") are each activated with a relative transmission (19) through a respective motor (20).

* * * * *